US006905176B2

(12) United States Patent
Boucherie

(10) Patent No.: US 6,905,176 B2
(45) Date of Patent: Jun. 14, 2005

(54) METHOD AND DEVICE FOR MANUFACTURING BRUSHES

(75) Inventor: Bart Gerard Boucherie, Izegem (BE)

(73) Assignee: Firma G.B. Boucherie N.V., Izegem (BE)

( * ) Notice: Subject to any disclaimer, the term of this patent is extended or adjusted under 35 U.S.C. 154(b) by 0 days.

(21) Appl. No.: 10/703,600

(22) Filed: Nov. 10, 2003

(65) Prior Publication Data

US 2004/0090108 A1 May 13, 2004

Related U.S. Application Data

(62) Division of application No. 09/824,660, filed on Apr. 4, 2001, now abandoned.

(30) Foreign Application Priority Data

Apr. 4, 2000 (BE) ..... 2000/0242

(51) Int. Cl.[7] ..... A46D 1/08; A46D 3/08

(52) U.S. Cl. ..... 300/21; 300/7

(58) Field of Search ..... 300/2, 7, 21

(56) References Cited

U.S. PATENT DOCUMENTS

| | | | |
|---|---|---|---|
| 4,255,224 | A | 3/1981 | Lorenz |
| 4,733,917 | A | 3/1988 | Boucherie |

FOREIGN PATENT DOCUMENTS

| | | |
|---|---|---|
| BE | 881914 | 8/1980 |
| BE | 895131 | 3/1983 |
| DE | 197 45 024 | 4/1999 |
| EP | 0 916 283 | 5/1999 |

*Primary Examiner*—Randall Chin
(74) *Attorney, Agent, or Firm*—Bacon & Thomas, PLLC

(57) ABSTRACT

Method for manufacturing brushes, whereby, on one hand, fibers (3) are supplied to at least one filling tool (4) by means of at least one auxiliary device (15) comprising at least two fiber loading chambers (16–20) and, on the other hand, said fiber loading chambers (16–20) are replenished by taking up fibers (3) from at least two respective fiber supply channels (8–12), whereby, by means of the filling tool (4), the fibers (3) are inserted into brush bodies (6), wherein, on one hand, the supply of the fibers (3) from the fiber loading chambers (16–20) to the filling tool (4) and, on the other hand, the replenishing of the fiber loading chambers (16–20) with fibers (3) from the fiber supply channels (8–12) is realized by means of working cycles which as such are independent.

5 Claims, 5 Drawing Sheets

METHOD AND DEVICE FOR MANUFACTURING BRUSHES

CROSS-REFERENCE TO RELATED APPLICATIONS

This application is a divisional of patent application Ser. No. 09/824,660 filed Apr. 4, 2001, now abandoned.

BACKGROUND OF THE INVENTION

1. Field of the Invention

This invention relates to a device for manufacturing brushes.

More particularly, it relates to a method whereby, on one hand, fibers are supplied to at least one filling tool by means of at least one auxiliary device comprising at least two fiber loading chambers and, on the other hand, said fiber loading chambers are replenished by taking up fibers from at least two respective fiber supply channels, whereby, by means of the filling tool, the fibers are inserted into brush bodies.

2. Description of the Related Art

A device of the above-described kind is already known from the European patent application No. 0.916.283. According to the device described therein, the auxiliary device consists of a disk-shaped intermediary element which, along its entire periphery, is provided with fiber loading chambers, whereby, whereas the fiber loading chambers at one location along the periphery cooperate with the filling tool in order to provide said filling tool with fibers, the fiber loading chambers at another location along the periphery cooperate with the fiber supply channels in order to be replenished with fibers from said fiber supply channels. As a result thereof, fibers can easily be supplied selectively out of several fiber supply channels to a filling tool.

SUMMARY OF THE INVENTION

The invention aims at a method which also allow to easily supply fibers selectively out of several fiber supply channels to a filling tool, whereby such method is optimized in many aspects and therefore offers additional advantages.

To this aim, the invention in the first place relates to a method for manufacturing brushes, whereby, on one hand, fibers are supplied to at least one filling tool by means of at least one auxiliary device comprising at least two fiber loading chambers and, on the other hand, said fiber loading chambers are replenished by taking up fibers from at least two respective fiber supply channels, whereby, by means of the filling tool, the fibers are inserted into brush bodies, with as a characteristic that, on one hand, the supply of the fibers from the fiber loading chambers to the filling tool and, on the other hand, the replenishing of the fiber loading chambers with fibers from the fiber supply channels is realized by means of working cycles which as such are independent. By independent working cycles, thereby it is intended that the movements performed by the fiber loading chambers take place independently from each other, at least in certain aspects. As a result of said independency, the advantage is obtained that the displacement of the fiber loading chambers at the moment when they cooperate with the filling tool, can be optimized in function of the filling movement, whereas, apart therefrom, the displacement of the fiber loading chambers at the moment when they cooperate with the fiber supply channels, can be optimized in function of the replenishing of the fiber loading chambers.

Preferably, such optimization consists in that said fiber loading chambers during said two working cycles are moved at different average speeds, whereby the speed during replenishing is lower than the speed during the supply of the fibers to the filling tool. More particularly, the fiber loading chambers, during the supply of the fibers to the filling tool, will be moved at a high speed, for example, of more than 500 cycles/minute, whereas this during the replenishing of the fiber loading chambers takes place at a speed which is considerably lower, for example, is that low that approximately two fiber loading chambers per second are replenished. As one works with different speeds, thus the advantage is obtained that the replenishing of the intermediary loading chambers in respect to the speed no longer is coupled to the speed at which the filling tool is working, as a result of which the intermediary loading chambers can be filled rather slow, which in its turn results in a better filling, as well as in less malfunctions when transferring fibers from the fiber supply channels to the intermediary loading chambers.

In practice, it is preferred that, on one hand, the fiber loading chambers, at the moment of their cooperation with the filling tool, are moved to and fro according to a certain pattern, such that successively the appropriate fibers are presented to the filling tool and that, on the other hand, during replenishing, these fiber loading chambers systematically and successively are presented opposite to the fiber supply channels. In this manner, it is obtained that the fiber loading chambers are replenished in a smooth movement, which improves the correct working and the exclusion of malfunctions.

In a preferred form of embodiment, one or more intermediary magazines will be used which each comprise a series of two or more of said fiber loading chambers, whereby each respective intermediary magazine is rotated between a position in which it cooperates with the filling tool, and a position in which it cooperates with the fiber supply channels.

Furthermore, in the most preferred form of embodiment use is made of at least two intermediary magazines which each comprise at least a series of two or more of said fiber loading chambers, whereby, during the cooperation of one intermediary magazine with the filling tool, one or more other intermediary magazines are replenished, and in this manner always an intermediary magazine is made available for the filling tool. In this way, the continuity of the supply of fibers to the filling tool can be guaranteed, whereas independent working cycles, as mentioned in the aforegoing, still can be provided for.

Moreover, the invention also involves a device for manufacturing brushes, in other words, a brush manufacturing machine, more particularly a device which allows to realize brushes according to the method described heretofore. To this aim, a device is concerned which comprises at least one filling tool and a fiber magazine with at least two fiber supply channels, with as a characteristic that it also comprises an auxiliary device with at least two fiber loading chambers, which auxiliary device independently cooperates, on one hand, with the fiber supply channels in order to take up fibers therefrom, and, on the other hand, with the filling tool in order to feed the latter with fibers.

Preferably, the auxiliary device hereby comprises at least two intermediary magazines, each with a series of two or more fiber loading chambers, and it is provided with drive means allowing to displace the intermediary magazines, such that, when one intermediary magazine cooperates with the filling tool, one or more other intermediary magazines are replenished, and in this manner there is always an intermediary magazine made available for the filling tool.

In order to be able, on one hand, to guarantee a smooth continuous working and, on the other hand, to obtain a construction with a minimum number of components, the auxiliary device preferably is equipped with exactly two intermediary magazines.

Preferably, the intermediary magazines are rotatable, more particularly along one and the same axis. In a practical form of embodiment, they consist to this end of elements in the shape of a circle segment, whereby these intermediary magazines are rotatable in one and the same plane.

In practice, it is preferred that the auxiliary device is provided with driven means which allow to displace the fiber loading chambers during the aforementioned two working cycles at different average speeds, whereby the average speed during replenishing is lower than the average speed during the supply of fibers to the filling tool.

Preferably, the fiber supply channels are provided in a shiftable fiber magazine, whereby a passage is formed in between the auxiliary device and the fiber magazine, in such a manner that by moving said fiber loading chambers and fiber supply channels systematically along each other, the fiber loading chambers are replenished with fibers.

Although the invention is useful starting with the fact that selectively fibers have to be taken up from two fiber supply channels and have to be supplied to a filling tool, it will take effect in an even more optimum manner in applications in which the selective fiber supply has to be performed from more than two fiber supply channels. In a practical commercial embodiment, the device will comprise five fiber supply channels, whereby the auxiliary device is equipped with intermediary magazines with each five fiber loading chambers.

BRIEF DESCRIPTION OF THE DRAWINGS

With the intention of better showing the characteristics of the invention, hereafter, as an example without any limitative character, a preferred form of embodiment is described, with reference to the accompanying drawings, wherein.

DETAILED DESCRIPTION OF PREFERRED EMBODIMENTS

Figure 1:
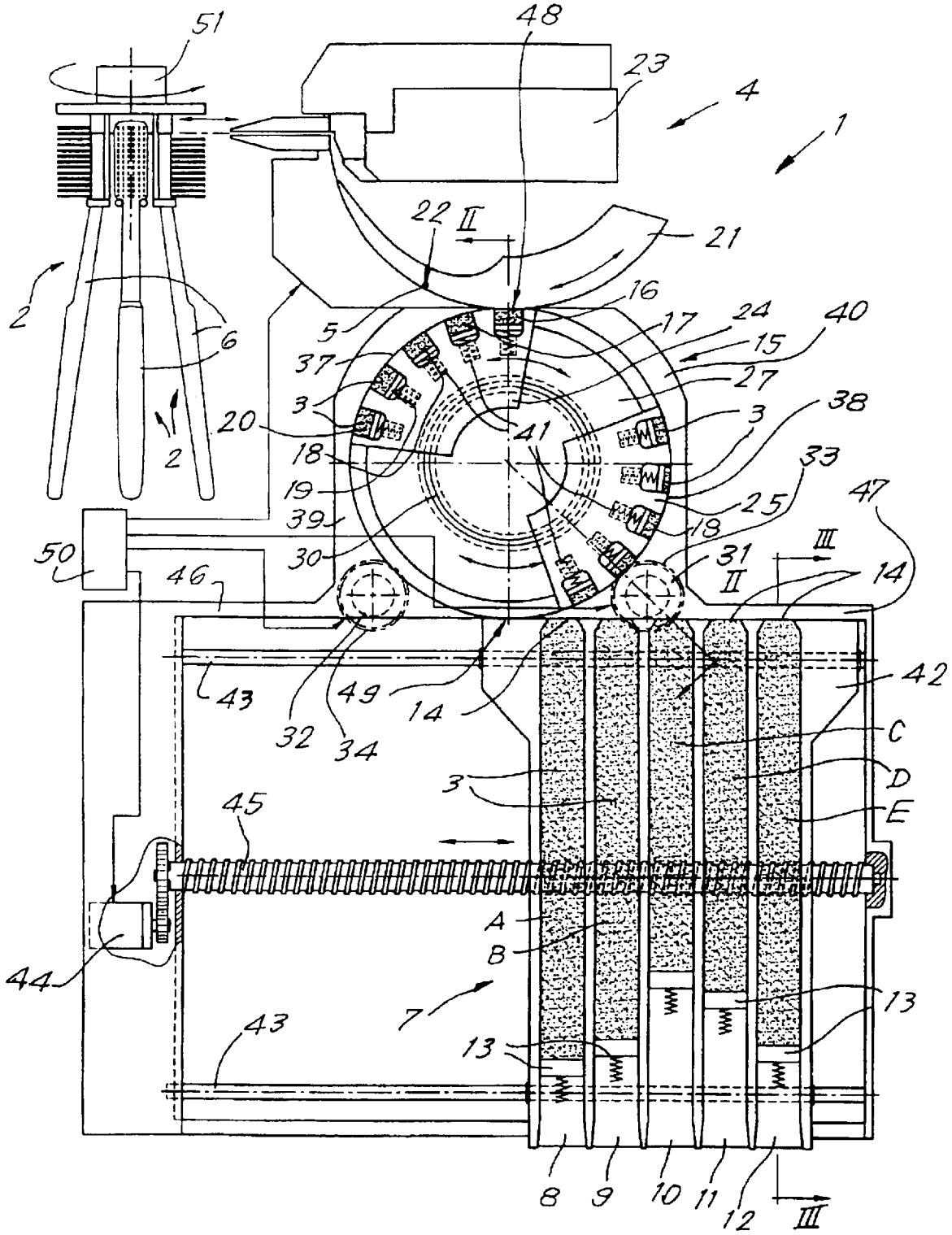
FIG. 1 in plan view represents a device according to the invention.

As represented in FIG. 1, the invention relates to a method for manufacturing brushes 2, using, for example, device 1, whereby fibers 3 are supplied to a filling tool 4 which systematically, according to a well-defined pattern, inserts fiber bundles 5, formed of fibers 3, into brush bodies 6.

Hereby, the fibers 3 are supplied from a fiber magazine 7 which, in a known manner, is provided with fiber supply channels, in this case, a quantity of fiber channels 8 to 12, respectively. The fiber magazine 7 is in a known manner provided with pressing-on means 13 which press the fibers 3 towards the extremities 14 of the fiber supply channels 8–12. The fiber supply channels 8–12 may be filled with different fibers 3, whereby these fibers 3 may be of different kinds, which means that the fibers 3 can have different sizes and/or can be of different colours and/or of different kind. The difference in fibers 3 is indicated by the letters A-B-C-D-E. The fiber supply channels 8–12 can be manually or automatically provided with fibers 3.

Between the fiber magazine 7 and the filling tool 4, an auxiliary device 15 is present with at least two fiber loading chambers, however, in the represented example with two series of five fiber loading chambers, 16 to 20, respectively, which can cooperate, on one hand, with the fiber supply channels 8–12 in order to take up fibers 3 therefrom, and, on the other hand, with the filling tool 4 in order to supply the latter with fibers 3. The filling tool 4 is equipped in a known manner with a bundle take-up element 21 with an opening 22 through which fiber bundles 5 are separated out of the fiber loading chambers 16–20 and are presented in front of a filling mechanism 23, whereby this latter inserts the fibers 3 into the brush bodies 6. The bundle take-up element 21 and the filling mechanism 23 are driven in a known, not represented manner.

The particularity of the invention consists in that the auxiliary device 15 is realized such that the fiber loading chambers 16–20 can cooperate by means of independent working cycles, on one hand, with the filling tool 4 and, on the other hand, with the fiber supply channels 8 to 12.

In the represented example, the auxiliary device 15 to this end is equipped with two intermediary magazines 24–25 in which each time one of said series of fiber loading chambers 16-17-18-19-20 is present.

The intermediary magazines 24–25 are rotatable, in this case, along one and the same axis of rotation 26. They are formed of elements in the shape of a circle segment, whereby these elements are rotatable in one and the same plane around said axis of rotation 26.

Figure 2:
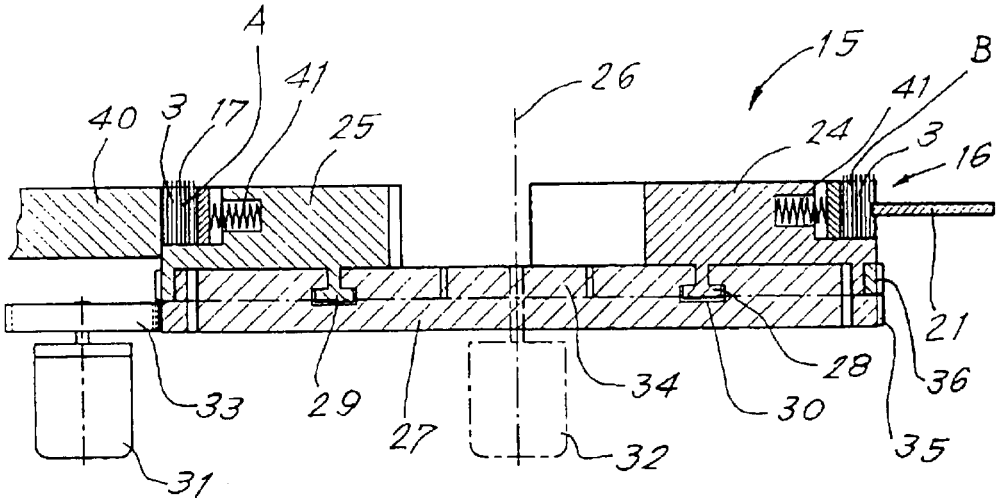
FIGS. 2 and 3, at a larger scale, represent cross-sections according to lines II—II and III—III in FIG. 1.

As can be seen in the cross-section of FIG. 2, the intermediary magazines 24–25 consist of slides which can be displaced in a common carrier 27, by means of coupling means which, in the represented example, consist of elements 28–29 provided at the intermediary magazines 24–25, which elements can be moved in a circle-shaped groove 30.

The intermediary magazines 24–25 each are driven by means of a separate motor 31–32. In the represented example, these are electric motors, for example, servo motors, however, it is clear that also linear motors can be applied, or drive cylinders which are coupled to the intermediary magazines 24–25 in a suitable manner. By means of transmissions formed, in the case of gearwheels 33–34 cooperation with gear rims 35–36, the motors 31–32 provide for the rotation of the intermediary magazines 24–25. The gear rims 35–36 are completely circle-shaped. Of course, according to variants, the motors also can be arranged otherwise and other transmissions can be applied.

As can be seen in FIG. 1, the intermediary magazines 24–25, at their outer edges 37–38, cooperate with surrounding guides 39–40. The fiber loading chambers 16–20 are situated with their open extremities against the outer edged 37–38 and are provided with schematically represented pressing-on means 41 which press the fibers 3 present therein radially outward.

In the represented example, the fiber magazine 7 is made slidable and consists of a slide 42 in which the aforementioned fiber supply channels 8–12 are provided.

Figure 3:
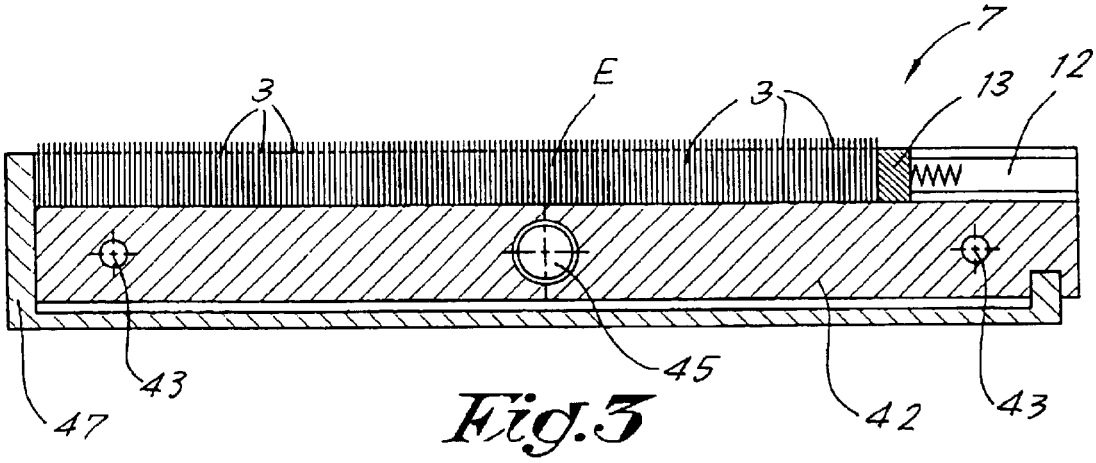

To this aim, the slide 42 is mounted in a slidable manner on guides 43 and can be displaced by means of a worm gear 45 driven by a motor 44, which worm gear, as represented in FIG. 3, engages in the slide 42.

At said extremities 14 of the fiber supply channels 8–12, the slide 42 is situated against guides 46–47 which prevent that the fibers 3 can exit the fiber supply channels 8–12 at undesired locations.

In between the guides 39–40, an opening 48 is formed which allows to push the fibers 3 from the fiber loading chambers 16–20 into opening 22. At the opposite side of the auxiliary device 15, then an opening 49 is present, such that fibers from a fiber supply channel 8–12 presented opposite this opening 49 can be brought from said channel into a fiber loading chamber 16–20 also presented to the opening.

The auxiliary device 15 is provided with drive means which move the fiber loading chambers 16–20 during the aforementioned two working cycles at different average speeds. The speed during replenishing of the fiber loading chambers 16–20 is lower than the speed during the supply of fibers 3 to the filling tool 4. The motors 31–32 are controlled by means of a control unit 50. The control unit 50 provides at least three of the following control functions: (1) the displacement of the intermediary magazines 24–25 positions between in which they cooperate with the filling tool 4, and the filling tool 4 and a position in which they cooperate with the fiber supply channels 8–12, (2) the displacement of each intermediary magazine 24–25 at the moment when they cooperate with a filling tool 4 to provide fibers 3 to the filling tool 4 according to a certain pattern, and (3) the displacement of each intermediary magazine 24–25 at the moment when they cooperate with the fiber supply channels 8–12 to replenish the fiber loading chambers 16–20 with fibers 3.

The brush bodies 6 are brought in front of the filling tool 4 by means of a workpiece holder 51. Such workpiece holders 51, which mostly are made in the form of a drum and with which the brush bodies 6, apart from into the filling station, also are brought into other processing stations, are sufficiently known in themselves and therefore they are not explained to greater detail.

The working of the device substantially is as explained hereafter by means of FIGS. 1, 4, 5 and 6.

In the condition of FIG. 1, the intermediary magazine 24 cooperates with the bundle take-up element 21. Hereby, said intermediary magazine 24 is moved to and fro at a high speed, according to a certain pattern and with a rhythm that is synchronous to the rhythm of the bundle take-up element 21, in such a manner that in the desired sequence fibers 3 of the kind A or B or C or D or E are pushed into opening 22, such by placing the corresponding fiber loading chambers 16 to 20 suitably in front of the aforementioned opening 48. The rhythm kept during this working cycle usually will be higher than 500 cycles/minute and mostly will be 800 to 1000.

The intermediary magazine 25 is in a condition in which the pertaining fiber loading chambers 16–20 have to be replenished. Hereby, it is brought into a position in which it is situated with one extremity close to opening 49.

Figure 4:
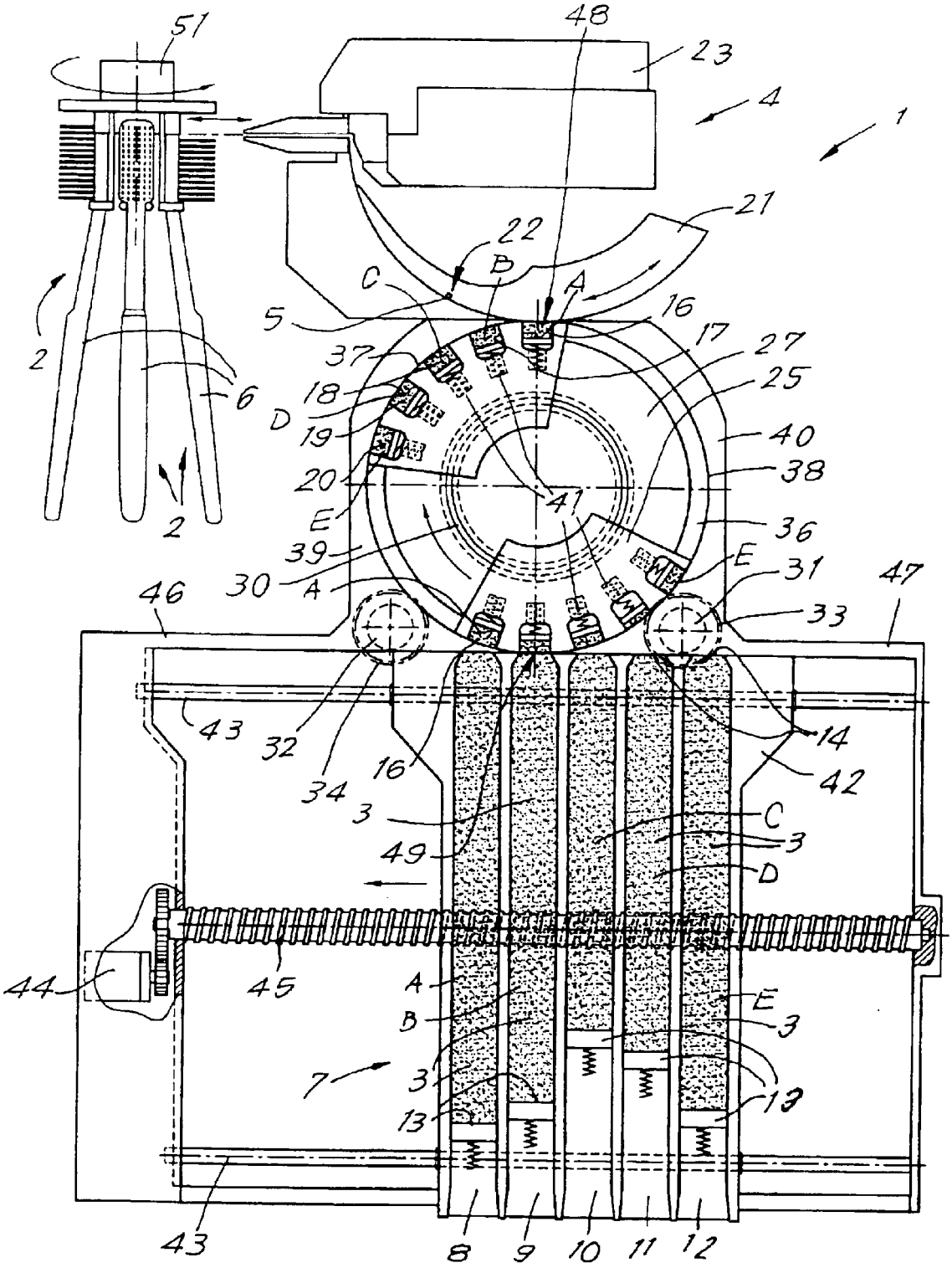
FIGS. 4, 5 and 6 represent a view analogous to that of FIG. 1, however, for different positions.
Figure 5:
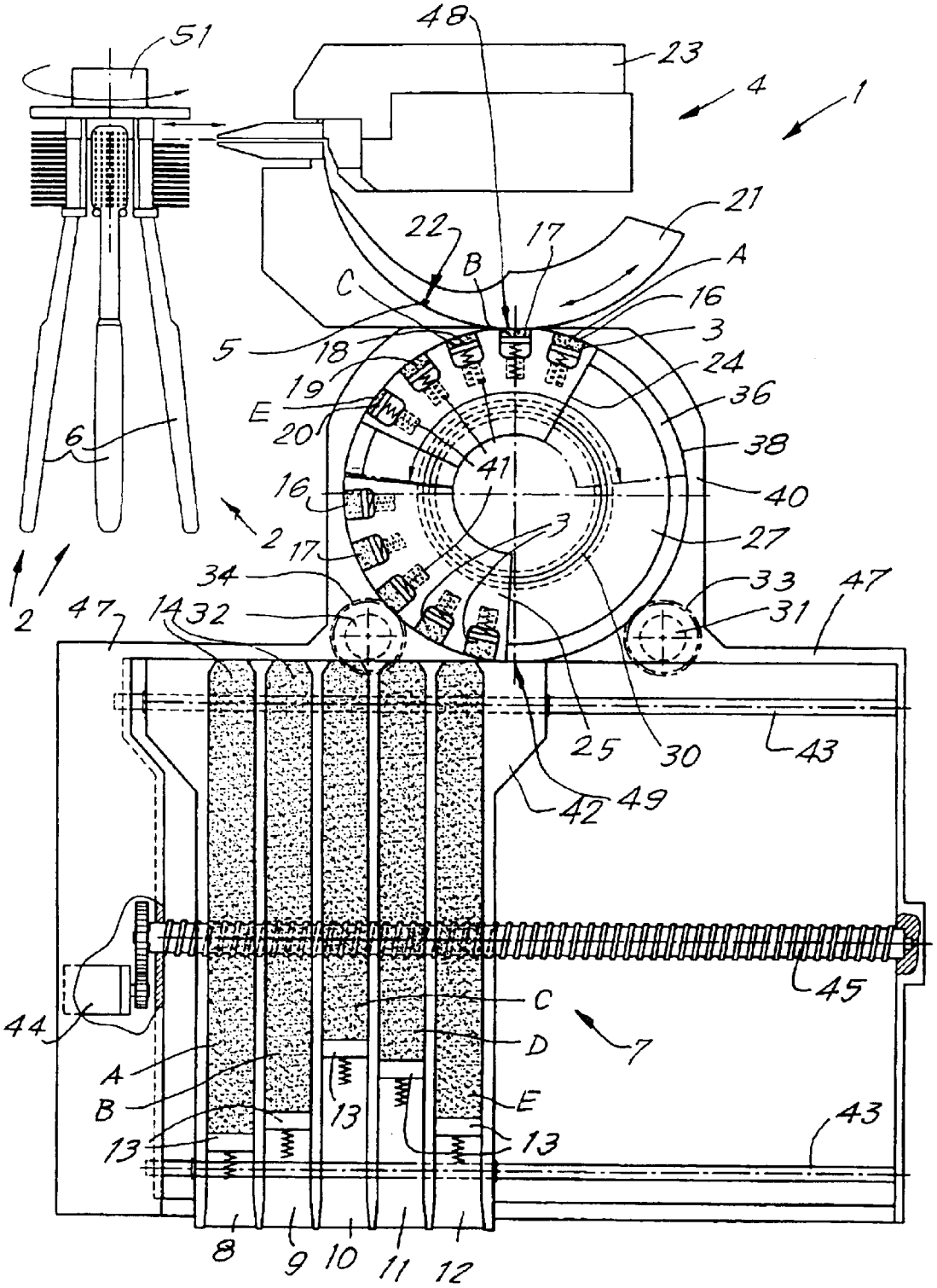

In a subsequent step, as represented in FIG. 4, the fiber magazine 7, by means of motor 44, is shifted to the left, whereas, preferably simultaneously, the intermediary magazine 25 is turned along opening 48, such that, step by step, the fiber supply channel 8 is brought into connection with fiber loading chamber 16, fiber supply channel 9 with fiber loading chamber 17, fiber supply channel 10 with fiber loading chamber 18, and so on, until a final position is reached, as represented in FIG. 5, whereby the fiber loading chambers 16 to 20 of intermediary magazine 25 are completely refilled.

During the step described heretofore by means of FIGS. 4 and 5, the intermediary magazine 24 remains active, in other words, keeps delivering fibers 3 to said bundle take-up elements 21 at the aforementioned rhythm.

It is clear that the displacement of the intermediary magazine 25 during filling, however, can be performed with a much slower rhythm of movement, without the necessity of brisk to-and-fro movements, as a result of which a steady and trouble-free filling can be guaranteed with a large certainty.

Figure 6:
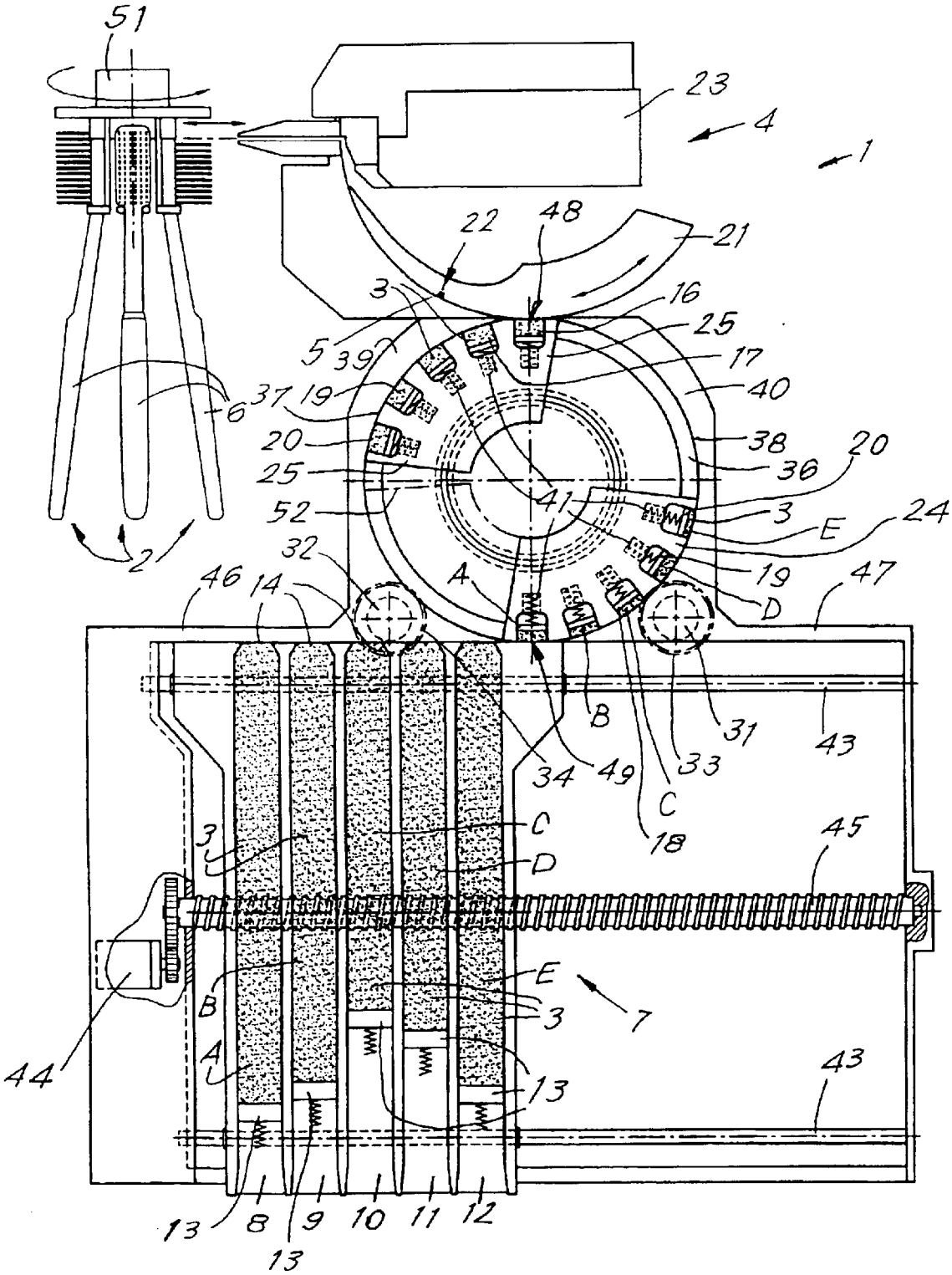

After filling, the intermediary magazine 25 is kept ready next to the moving intermediary magazine 24, and at a given moment, which is determined by control unit 50, the intermediary magazine 24 is turned about into a position as represented in FIG. 6, whereas the intermediary magazine 25 takes the place of intermediary magazine 24 in order to be subsequently moved with said fast rhythm and thus to provide the bundle take-up element 21 with fibers 3.

Subsequently, the intermediary magazine 24 to be replenished is turned further up into a position as indicated by dash-dot line 52 in FIG. 6. Thereafter, the filling of the fiber loading chambers 16–20 of the intermediary magazine 24 is realized by simultaneously displacing the intermediary magazine 24 and the fiber magazine 7. The fiber magazine 7 then moves to the right and the intermediary magazine 24 moves from the position represented in dash-dot line 52 in counterclockwise rotation.

Afterwards, the intermediary magazine 25 can be replaced by intermediary magazine 24 in an analogous manner, whereby the intermediary magazine 25 then is brought back into a position as represented in FIG. 1.

According to a not represented variant, one or more of the intermediary magazines can also be moved with a movement opposed to that of the fiber magazine 7. Then, of course, sufficient distances have to be kept in between the respective fiber loading chambers and in between the respective fiber channels in order to prevent that the fibers become mutually mixed in an undesired manner.

Also, controlled closing means can be provided in the opening or passage 49 which let the fibers 3 pass only if the desired fiber loading chamber is positioned opposite to the desired fiber supply channel. The aforementioned movements then no longer have to be performed simultaneously.

Likewise, the number of fiber loading chambers does not have to be equal to the number of fiber supply channels, and two or more fiber loading chambers can be replenished from one and the same fiber supply channel. Vice versa, one fiber loading chamber also can cooperate with several fiber supply channels.

It is clear that all aforementioned movements are realized by means of the motors 31-32-44 which, to this end, are commanded in a suitable manner by means of control unit 50 which is coupled to the filling tool 4. For clarity's sake, control unit 50 exclusively is represented in FIG. 1.

The alteration of the positions of intermediary magazines 24 and 25 can simply be determined in function of the quantity of fibers 3 taken from the fiber loading chambers 16–20, whereby the kind of fibers which is taken up most often, is determining for the period of time in which an intermediary magazine has to be replenished with fibers.

The working described heretofore also illustrates the method described in the introduction.

It is clear that different variants are possible. So, for example, do the intermediary magazines not have to be rotating and may also consist of slides which can be moved to and fro. The rotating embodiment, however, allows a very compact construction.

Also, the fiber magazine 7 can be realized in another manner. The fiber supply channels 8–12, for example, do not have to belong to one and the same slide 42. Also, instead of one or more slides 42, a mechanism can be used which allows another movement than shifting. So, for example, may the fiber supply channels 8–12 be provided in a rotatable segment, analogous to the fiber loading chambers 16–20.

It is also possible to work with only one intermediary magazine 24 or 25, whereby during replenishing, the filling cycle performed by the bundle take-up element 21 is interrupted or taken over by a second bundle take-up element, whereby this latter is fed with fibers 3 by means of another, possibly identical supply system.

Although the invention is represented in the drawings as for manufacturing toothbrushes, it is clear that it can also be applied for manufacturing other brushes.

The present invention is in no way limited to the forms of embodiment represented as an example, however, such method and device can be realized according to different variants, while still remaining within the scope of the invention.

What is claimed is:

1. A method for manufacturing brushes, comprising the steps of:

supplying fibers from at least two fiber loading chambers of an auxiliary device to at least one filling tool;

replenishing the at least two fiber loading chambers by removing fibers from at least two corresponding fiber supply channels; and inserting the fibers into brush bodies with the at least one filling tool;

wherein the auxiliary device is configured so that the steps of supplying the fibers to the filling tool and replenishing of the fiber loading chambers are performed in independent working cycles;

wherein the fiber loading chambers are moved at different operating speeds according to the working cycles such that the operating speed of replenishing the fiber loading chambers is lower than the operating speed of supplying fibers to the at least one filling tool.

2. The method according to claim 1, wherein the operating speed of the fiber loading chambers supplying fibers to the at least one filling tool is at least 500 cycles per minute, and the fiber loading chambers are replenished at a speed of at least two loading chambers per second.

3. The method according to claim 1, wherein the at least two fiber loading chambers are moved in a predetermined pattern at the moment of supplying fibers to the at least one filling tool such that successively fibers are presented to the at least one filling tool, and the fiber loading chambers are systematically and successively presented opposite to the fiber supply channels when replenishing the fiber loading chambers.

4. The method according to claim 1, wherein the auxiliary device includes at least one intermediary magazine provided with a plurality of fiber loading chambers, each intermediary magazine being rotatable between a position cooperating with the at least one filling tool and a position cooperating with the at least two fiber supply channels.

5. The method according to claim 1, wherein a plurality of the fiber loading chambers of the auxiliary device are replenished as the auxiliary device supplies fibers to the at least one filling tool, the auxiliary device having at least two intermediary magazines that are arranged such that as one of the intermediary magazines supplies fibers to the at least one filling tool, another of the intermediary magazines is replenished with fibers.

* * * * *